US010593247B2

(12) United States Patent
Zhuang et al.

(10) Patent No.: US 10,593,247 B2
(45) Date of Patent: Mar. 17, 2020

(54) METHODS AND APPARATUS TO IMPLEMENT AGING COMPENSATION FOR EMISSIVE DISPLAYS WITH SUBPIXEL RENDERING

(71) Applicant: Intel Corporation, Santa Clara, CA (US)

(72) Inventors: Zhiming J. Zhuang, Sammamish, WA (US); Srikanth Kambhatla, Portland, OR (US); Satyanarayana Avadhanam, El Dorado Hills, CA (US); Antonio Cheng, Portland, OR (US); Nobuyuki Suzuki, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 18 days.

(21) Appl. No.: 15/857,307

(22) Filed: Dec. 28, 2017

(65) Prior Publication Data

US 2018/0268752 A1 Sep. 20, 2018

Related U.S. Application Data

(60) Provisional application No. 62/472,823, filed on Mar. 17, 2017.

(51) Int. Cl.

| | |
|---|---|
| ***G09G 3/30*** | (2006.01) |
| ***G09G 3/20*** | (2006.01) |
| ***G09G 3/3233*** | (2016.01) |
| ***G09G 3/22*** | (2006.01) |
| *G09G 3/3208* | (2016.01) |

(52) U.S. Cl.

CPC ..... *G09G 3/2003* (2013.01); *G09G 3/2051* (2013.01); *G09G 3/2074* (2013.01); *G09G 3/22* (2013.01); *G09G 3/3233* (2013.01); *G09G 3/2044* (2013.01); *G09G 3/2048* (2013.01); *G09G 3/3208* (2013.01); *G09G 2300/0452* (2013.01); *G09G 2320/0233* (2013.01); *G09G 2320/0242* (2013.01); *G09G 2320/045* (2013.01); *G09G 2320/048* (2013.01);

(Continued)

(58) Field of Classification Search

CPC ..... G09G 3/2077; G09G 2320/0673; G09G 2320/0242; G09G 2300/0443; G09G 3/2074; G09G 3/2003; G09G 2310/0297; G09G 2330/021; G09G 2310/027

USPC ..... 345/76, 77, 613, 696

See application file for complete search history.

(56) References Cited

U.S. PATENT DOCUMENTS 8,031,205 B2 10/2011 Brown Elliott et al.
8,704,847 B2 4/2014 Higgins et al.

(Continued)

*Primary Examiner* — Jennifer T Nguyen

(74) *Attorney, Agent, or Firm* — Hanley, Flight & Zimmerman, LLC

(57) ABSTRACT

Methods and apparatus to implement aging compensation for emissive displays with subpixel rendering are disclosed. An example apparatus includes a converter to convert red-green-blue (RGB) data to subpixel rendering (SPR) data. The RGB data is indicative of an image to be rendered on an emissive display screen. The apparatus includes a compensator to apply pixel correction values to the SPR data to generate corrected SPR data to compensate for pixel degradation. The apparatus further includes a usage accumulator to track pixel usage based on the corrected SPR data. The apparatus also includes a correction calculator to calculate the pixel correction values based on the pixel usage.

24 Claims, 10 Drawing Sheets

(52) U.S. Cl.
CPC ..... *G09G 2340/0407* (2013.01); *G09G 2340/0457* (2013.01); *G09G 2370/04* (2013.01)

(56) References Cited

U.S. PATENT DOCUMENTS

| | | | | |
|---|---|---|---|---|
| 8,786,645 | B2 | 7/2014 | Gu | |
| 2012/0133835 | A1* | 5/2012 | Van Heesch | G09G 5/00 348/576 |
| 2018/0197454 | A1* | 7/2018 | Furihata | G09G 3/20 |

* cited by examiner

METHODS AND APPARATUS TO IMPLEMENT AGING COMPENSATION FOR EMISSIVE DISPLAYS WITH SUBPIXEL RENDERING

RELATED APPLICATION

This patent claims priority to U.S. Provisional Patent Application Ser. No. 62/472,823, which was filed on Mar. 17, 2017. U.S. Provisional Patent Application Ser. No. 62/472,823 is hereby incorporated herein by reference in its entirety.

FIELD OF THE DISCLOSURE

This disclosure relates generally to media display screens, and, more particularly, to methods and apparatus to implement aging compensation for emissive displays with subpixel rendering.

BACKGROUND

In emissive display screens, such as organic light emitting diode (OLED) display screens, the luminance of the individual light-emitting pixels degrades over time. The rate of degradation of a particular pixel depends upon the frequency of usage of the pixel as it ages. That is, the more frequently a pixel is activated, the more quickly the pixel will wear out and lose its luminance. Furthermore, the rate of degradation is different for the three primary colors. Some pixels (among the thousands to millions of pixels) within a display will be used more often than other pixels over time. The uneven degradation of luminance between different pixels in a display can produce undesirable effects such as color shift and/or burn-in patterns (also known as image sticking).

BRIEF DESCRIPTION OF THE DRAWINGS

The figures are not to scale. In general, the same reference numbers will be used throughout the drawing(s) and accompanying written description to refer to the same or like parts.

DETAILED DESCRIPTION

Figure 1:
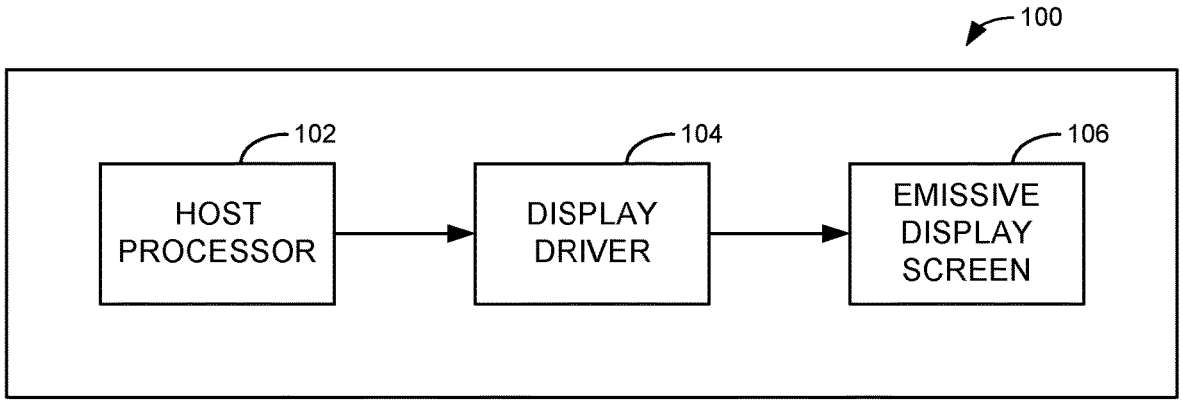
FIG. 1 is a block diagram illustrating an example emissive display device.

As used herein, an emissive display device is a media presentation device that includes an emissive display screen. As used herein, an emissive display screen (or simply an emissive display) is a display screen in which each subpixel directly emits light to render an image on the screen. This is contrasted with non-emissive display screens, such as liquid-crystal display (LCD) screens, that rely on a backlight to render a visible image on the screen.

Current approaches to reduce the effects of pixel aging in emissive displays involve the implementation of aging compensation processes that track pixel usage over time and apply pixel correction values to image data to be rendered on a display screen. Typically, pixel usage tracking and compensation is implemented using image data in a red-green-blue (RGB) data format. The aging compensation may be implemented within the host processor of the emissive display device or within the display driver circuitry (e.g., a timing controller (Tcon)). However, the processing capacity of either the host processor or the display driver circuitry is often inadequate to process all of the pixel information associated with relatively high-resolution (e.g., high definition, ultra-high definition) screens that are becoming common within the industry. While larger processors may mitigate some of these concerns, they may be cost prohibitive and/or inadequate as screen resolutions continue to increase. Furthermore, in some situations there are physical size constraints for processors housed in devices with smaller form factors (e.g., with screens 10 inches or smaller), particularly for a display driver circuitry (Tcon) based solution. As such, an additional and/or larger processor may not be a suitable option.

Examples disclosed herein increase the efficiency with which aging compensation is accomplished by performing the compensation on image data in a subpixel rendering (SPR) data format. Subpixel rendering is a technology that takes advantage of the fact that each pixel in a display typically includes multiple subpixels corresponding respectively to the three primary colors (red, green, and blue). Thus, each logic pixel represented in RGB data includes values for each of the three subpixels associated with each pixel. By contrast, the SPR format enables each logic pixel to include less than three full subpixels, thereby resulting in fewer total subpixels defining an image to be rendered when compared with the RGB format at the same screen resolution. More particularly, SPR data may have a total subpixel count that is as much as 30-50% less than the subpixel count for a similar resolution image defined by RGB data. This reduction in the subpixel count results in a reduction in the amount of data to be processed when compared with image data in the RGB format, thereby improving efficiency. Furthermore, the smaller amount of information to be processed for image data in the SPR format also reduces memory requirements for the image data in the SPR format that is to be stored. As used herein, image data in the SPR format is referred to herein as SPR data.

FIG. 1 is a block diagram illustrating an example emissive display device 100. The example emissive display device 100 may be any type of media presentation device such as, for example, a television, a laptop computer, a desktop computer, a tablet computer, a smartphone, a portable gaming system, etc.

In the illustrated example of FIG. 1, the example emissive display device 100 includes an example host processor 102, an example display driver 104, and an example emissive display screen 106. In some examples, the emissive display screen 106 is an OLED display screen. The host processor 102 may perform initial image processing on image data to be rendered via the display screen 106. For example, the host processor 102 may, among other things, scale the image data to correspond to the resolution of the display screen 106 and/or apply dither to the image data. In some examples, the host processor 102 provides the processed image data in a RGB pixel format to the display driver 104. Image data in the RGB format is referred to herein as RGB data.

In the illustrated example, the display driver 104 controls the delivery of image data to the display screen 106. In some examples, the display driver 104 is a timing controller (T-con). As mentioned above, in some known emissive display devices, the host processor performs image processing on image data in the RGB format and provides the resulting RGB data to the display driver. In some such instances, the display driver may convert the RGB data into SPR data before rendering an image via the display screen based on the SPR data. By contrast, in some examples disclosed herein, the conversion of the RGB data to SPR data is performed on the host processor side to improve the efficiency of subsequent processing of the host processor 102.

Figure 2:
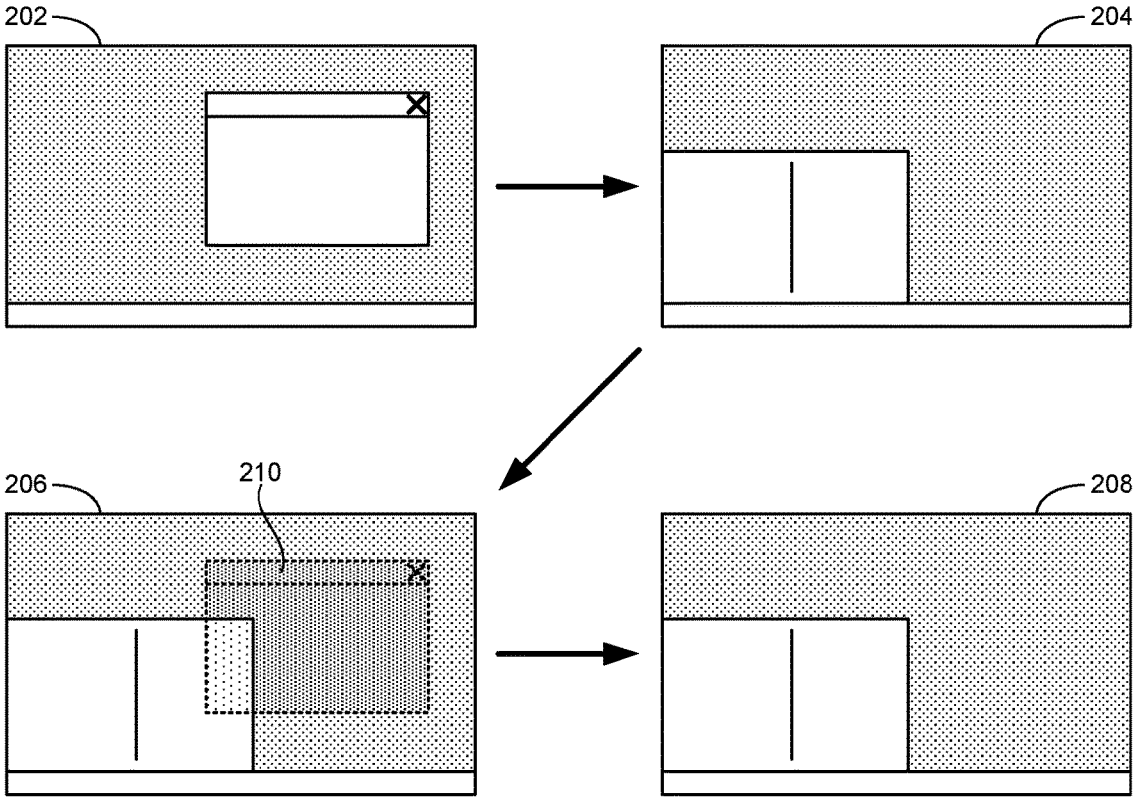
FIG. 2 represents example stages in an example aging compensation technique for the example emissive display device of FIG. 1.

In particular, the subsequent processing after converting the RGB data to SPR data involves correcting the data to compensate for pixel degradation. More specifically, the pixels (or more particularly, subpixels) of an emissive display exhibit degradation as they age over time. That is, as individual pixels are repeatedly used (e.g., powered to emit light), the luminance of the pixels weakens. In other words, a particular current applied to a pixel at a first point in time will result in the pixel having a luminance that will be greater than the luminance of the same pixel at a later point in time even though the same current is applied to the pixel. This phenomenon is sometimes referred to as pixel aging or pixel degradation. Pixel degradation is a function of the frequency and duration that pixels are used. Thus, pixels in a display screen that are used more frequently will age or degrade more quickly. Furthermore, subpixels associated with different colors age at different rates. Such uneven aging of pixels and/or subpixels can result in several undesirable effects. For example, pixel aging can result in an uneven luminance across a screen and/or result in color shift within a screen (e.g., as one color fades more quickly than another). Further, pixel aging can result in burn-in patterns appearing on a display screen. Accordingly, in some examples, the emissive display device 100 of FIG. 1 implements pixel aging compensation techniques to offset these effects as illustrated in FIG. 2. More particularly, the emissive display device 100 implements aging compensation based on image data in the SPR format. This increases efficiency and reduces memory requirements by taking advantage of the reduced total pixel count of SPR data relative to RGB data. Although this application refers to pixel aging or pixel degradation, such aging may occur differently for different subpixels within a single pixel. More generally, references to pixels through this patent are used synonymously with subpixels unless otherwise indicated based on the context. Thus, the processes, operations, and/or analysis described as being performed on pixels may, in some examples, additionally or alternatively be performed on subpixels. Likewise, the processes, operations, and/or analysis described as being performed on subpixels may, in some examples, additionally or alternatively be performed on pixels.

FIG. 2 represents example images 202, 204, 206, 208 during different stages in an example aging compensation technique for the example emissive display device 100 of FIG. 1. The first image 202 of FIG. 2 represents visual content that has been rendered on the display screen 106 for an extended period of time (e.g., 5 hours or more). The second image 204 of FIG. 2 represents new visual content that is to be rendered on the display screen 106 to replace the visual content shown in the first image 202. That is, the second image 204 represents the desired visual content to be displayed. However, when the desired image 204 is actually rendered via the display screen 106, a burn-in pattern 210 may appear (as represented in the third image 206) in which remnants of the first image 202 appear due to the degradation of the pixels used to render the first image 202. This phenomenon is sometimes referred to as image sticking. The fourth image 208 represents the result of aging compensation, which is intended to substantially match the desired image to be shown represented by the second image 204.

In actual implementation, the second and third images 204, 206 would not be rendered via the display screen 106 but are shown in FIG. 2 for purposes of explanation. More particularly, the emissive display device 100 implements an aging compensation process so that the actual content rendered on the display 106 will go directly from the first image 202 to the fourth image 208. As described more fully below, aging compensation is accomplished by tracking the usage of each pixel on the display screen 106 over time and calculating compensation values for each pixel based on their historical usage. The compensation values define changes to the current or voltage sent to each pixel (as defined by the image data) so that the proper luminance for each pixel will be produced despite uneven aging of different ones of the pixels.

As mentioned above, known aging compensation techniques is typically implemented using image data while in the RGB format and it is not until the associated RGB data is transmitted to the display driver 104 that the RGB data may be converted to SPR data before being rendered via the display screen 106. Thus, existing aging compensation approaches do not take advantage of the efficiencies that can be achieved by processing the data in the SPR format. Furthermore, implementing aging compensation based on RGB data that is then converted to SPR data is potentially ineffective because SPR data uses subpixels of a display screen 106 differently than they are used based on RGB data. As a result, tracking and analyzing usage of pixels based on RGB data is not necessarily representative of the actual usage of the screen pixels as illuminated based on SPR data. Therefore, even if a host processor were to track the historical usage of pixels (based on RGB data) and apply correction values to compensate for the aging of pixels indicated by such usage, there is no guarantee that the corrected RGB data would result in a correct rendering of visual content once the RGB data is converted to SPR data.

Examples disclosed herein overcome the above challenges to emissive displays by performing aging compensation operations via the host processor 102 after the RGB data has been converted to SPR data. In some examples, the host processor 102 converts the RGB data to SPR data before tracking the usage of pixels and then corrects the SPR data in a manner that compensates for pixel degradation. In some such examples, the corrected SPR data is passed to the driver display 104 to render the visual content represented by the corrected SPR data. In other examples, a hybrid approach is implemented in which the host processor 102 may convert the RGB data to SPR data and track the usage of pixels to calculate pixel correction values. However, rather than correcting the SPR data to compensate for pixel degradation, the host processor 102 may pass the pixel correction values, along with the uncorrected RGB data, to the driver display 104. Once received, the display driver 104 will convert the RGB data to SPR data and correct the SPR data based on the provided pixel correction values. As used herein, the phrase pixel correction values may refer to correction values assigned to complete pixel or to correction values assigned to individual subpixels within the pixels of a display screen.

Figure 3:
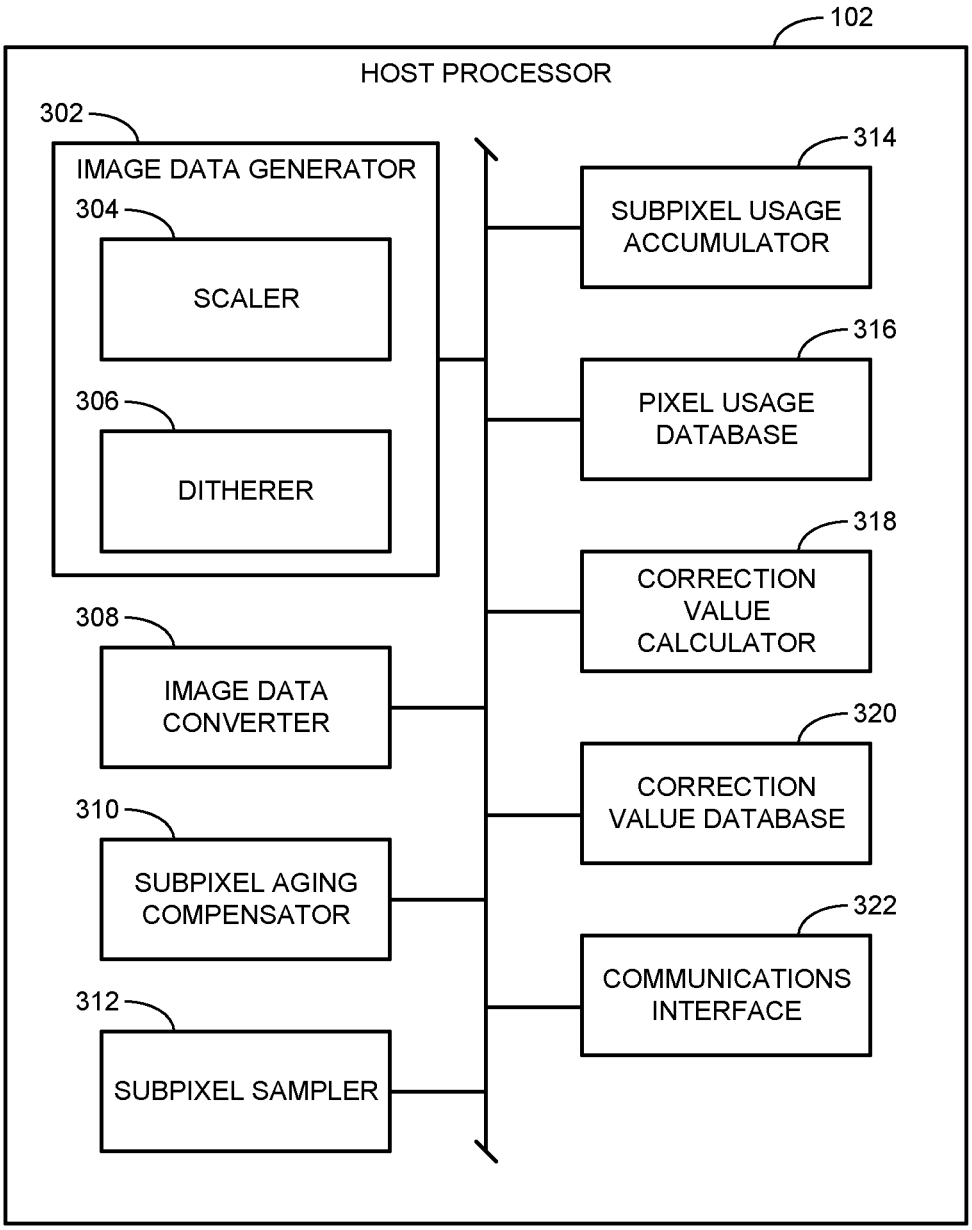
FIG. 3 is a block diagram illustrating an example implementation of the host processor of the example emissive display device of FIG. 1.

FIG. 3 is a block diagram illustrating an example implementation of the host processor 102 of the example emissive display device 100 of FIG. 1. As shown in FIG. 3, the host processor 102 includes an example image data generator 302 (that includes an example scaler 304 and an example ditherer 306), an example image data converter 308, an example subpixel aging compensator 310, an example subpixel sampler 312, an example subpixel usage accumulator 314, an example pixel usage database 316, an example correction value calculator 318, an example correction value database 320, and an example communications interface 322.

In the illustrated example of FIG. 3, the example image data generator 302 performs image processing on image data to be rendered on the display screen 106. In some examples, the image data generator 302 includes the scaler 304 to scale the image data to correspond to the resolution of the display screen 106. In some examples, the image data generator 304 includes the example ditherer 306 to apply dither to the image data. That is, the ditherer 306 may apply noise to the image data to randomize quantization error and reduce undesirable effects such as color banding. In this example, the image data generator 302 implements its functions using RGB data and outputs the final RGB data indicative of the visual content intended to be rendered via the display screen 106. Of course, as mentioned above what is intended to be displayed is not necessarily what will be displayed due to the aging of pixels on the screen 106 (as represented by the second and third images 204, 206 of FIG. 2). Thus, while the RGB data generated by the image data generator 302 may be final in that they represent the intended visual content, the host processor 102 may implement further post-processing operations on the image data to compensate for pixel degradation.

The host processor 102, in the example of FIG. 3, is provided with the example image data converter 308 to convert the RGB data generated by the image data generator 302 into SPR data. After this conversion, the example subpixel aging compensator 310 may apply pixel correction values to the SPR data to compensate for pixel degradation. More particularly, in some examples, the subpixel aging compensator 310 applies pixel correction values to compensate for degradation of separate subpixels. That is, in some examples, the pixel correction values are applied at the subpixel level to individual subpixels. In other examples, the pixel correction values may correspond to full pixels and are applied at the pixel level. In some examples, applying the pixel correction values involves applying a compensation mask. In some examples, the pixel correction values are stored in a lookup table. Implementing such compensation after the conversion of RGB data to SPR data increases the efficiency of the host processor 102 because image data in the SPR format is associated with a smaller total subpixel count than RGB data. Once the SPR data has been corrected, the communications interface 322 may transmit the corrected SPR data to the display driver 104 to render the visual content represented by the SPR data via the display screen 106. In some examples, the corrected SPR data may be sent according to the SPR formatted protocol. In other examples, the communications interface 322 transmits the corrected SPR data encapsulated within the RGB data according to the RGB format protocol. In such examples, the display driver 104 will extract the SPR data from the RGB data protocol based on a pre-defined data format.

In the illustrated example, the pixel correction values are based on the historical usage of subpixels of the display screen 106 identified according to the SPR format. To generate such historical usage of subpixels, the example host processor 102 includes the example subpixel sampler 312 to sample pixel values associated with subpixels indicated in the SPR data that has been corrected by the subpixel aging compensator 310. That is, the corrected SPR data generated by the subpixel aging compensator 310 represents the actual data used to control the pixels (and/or the subpixels) of the display screen 106. Inasmuch as the corrected SPR data corresponds to what is actually used to control the display screen 106, the corrected SPR data is representative of the actual usage of the pixels of the display screen 106. Accordingly, by sampling the corrected SPR data, the subpixel sampler 312 is able to determine the actual usage history of the subpixels of the display screen 106. This is an improvement over existing approaches that compensate the RGB data that is subsequently converted to SPR data because such compensation is not based on the actual usage of the display screen pixels.

In some examples, the subpixel sampler 312 may sample or collect data for every subpixel of every frame of visual content. In other examples, to reduce processing and memory demands, the subpixel sampler 312 may sample less than all of the subpixel information by omitting certain subpixels in time and/or in space. That is, in some examples, the subpixel sampler 312 may sample the subpixels of every other image frame or at any other suitable frequency on the assumption that the usage of pixels from one frame to the next is unlikely to vary significantly. Additionally or alternatively, in some examples, the subpixel sampler 312 may sample a subset of all the subpixels associated with the display screen 106 in a single frame by sampling spatially separated color subpixels (e.g., every other pixel, every third pixel, etc.) based on the assumption that the usage of adjacent color subpixels at any given point in time is unlikely to vary significantly.

In the illustrated example of FIG. 3, the example subpixel usage accumulator 314 accumulates or adds up the usage of subpixels over time based on the sampling performed by the subpixel sampler 312. That is, in some examples, each time a subpixel is used, as reported by the subpixel sampler 312, the subpixel usage accumulator 314 may increase the total amount of usage recorded for the subpixel. The historical usage data generated by the subpixel usage accumulator 314 is referred to herein as pixel usage data and may be stored in the pixel usage database 316. In some examples, the pixel usage database is associated with non-volatile memory so that the historical values are preserved even after the emissive display device 100 is powered off. The pixel usage data accumulated by the pixel usage accumulator 314 is based on the SPR format because, as described above, the example subpixel sampler 312 is sampling SPR formatted image data. As such, this approach reduces the memory requirements for the pixel usage database 316 relative to other existing approaches because SPR data is associated with a reduced subpixel count relative to RGB data.

The example correction value calculator 318 of the example host processor 102 calculates pixel correction values for each of the pixels (and associated subpixels) of the display screen 106. The pixel correction values may be stored in the correction value database 320. In some examples, the pixel correction values correspond to a compensation mask (e.g., an alpha blend) stored in a lookup table. The example correction value calculator 318 calculates the pixel correction values based on the pixel usage data stored in the pixel usage database 316 (as updated by the subpixel usage accumulator 314). For example, as described above, subpixels that have experienced more usage than other subpixels are likely to have experienced more degradation than the other subpixels. Accordingly, the example correction value calculator 318 may assign a larger correction value to those pixels (and/or associated subpixels) that have aged more so that the current delivered to such pixels will be greater than for the other pixels to maintain the desired amount of luminance for all of the pixels. Alternatively, the example correction value calculator 318 may assign a larger correction value to those pixels (and/or associated subpixels) that have aged less so that the current delivered to such pixels will be smaller than for the other pixels to maintain the desired amount of luminance for all of the pixels. Furthermore, the example correction value calculator 318 may use an algorithm that is a combination of the two previous examples. The pixel correction values calculated by the example correction value calculator 318 correspond to the SPR format because they are calculated based on pixel usage data that is, itself based on SPR data. As mentioned above, SPR data may be represented by less data than RGB data because of the smaller total subpixel count. As a result, calculating pixel correction values based on SPR data as disclosed herein enhances the efficiency of the host processor 102.

The pixel correction values calculated by the example correction value calculator 318 are used by the subpixel aging compensator 310 to compensate or correct the SPR data generated by the image data converter 306. Thus, as demonstrated by the foregoing description, the operations to implement aging compensation involve a loop. As new image data is received and converted to SPR data (by the image data converter 308), the data is corrected (by the subpixel aging compensator 310) to generate corrected SPR data that is provided to the display driver 104 to control the actual rendering of visual content via the display screen 106. Additionally, in some examples, the corrected SPR data is sampled (by the subpixel sampler 312) to then update the pixel usage data (by the usage data accumulator 314). The updated pixel usage data is used to calculate updated pixel correction values (by the correction value calculator 318) to update the pixel correction values used by the subpixel aging compensator 310.

While the subpixel aging compensator 312 may apply the current pixel correction values to every frame of image data (so that the rendered image is always accurate), the other operations in the above loop need not occur for every frame. As mentioned above, the subpixel sampler 312 may skip one or more frames between each sampling event. As no newly sampled data is generated during the times associated with the frames that are not sampled, there is no new pixel usage data to accumulate and, therefore, no basis to update the calculations of the pixel correction values. However, each time the subpixel sampler 312 samples the corrected SPR data, the other operations in the loop may follow.

In some examples, the communications interface 322 may pass the RGB data generated by the image data generator 302 directly through to the display driver 104. In some such examples, the communications interface 322 may separately transmit the pixel correction values as calculated by the correction value calculator 318 as described above. In such examples, the display driver 104 may convert the RGB data to SPR data and apply the subpixel correction value to the SPR data to generate corrected SPR data that corresponds to the actual values to be used to render visual content via the display screen 106. This approach bifurcates the process to correct the SPR data (performed on the display drive side) from the process to calculate the pixel correction values (performed on the host processor side) used to correct the SPR data. The bifurcation of these processes in this manner enables greater flexibility in controlling the frequency at which the SPR data is sampled at the host processor 102 to update the pixel correction values.

While an example manner of implementing the host processor 102 of FIG. 1 is illustrated in FIG. 3, one or more of the elements, processes and/or devices illustrated in FIG. 3 may be combined, divided, re-arranged, omitted, eliminated and/or implemented in any other way. Further, the example image data generator 302 (including the example scaler 304 and the example ditherer 306), the example image data converter 308, the example subpixel aging compensator 310, an example subpixel sampler 312, the example subpixel usage accumulator 314, the example pixel usage database 316, the example correction value calculator 318, the example correction value database 320, the example communications interface 322, and/or, more generally, the example host processor 102 of FIG. 3 may be implemented by hardware, software, firmware and/or any combination of hardware, software and/or firmware. In particular, example arrangements that implement the host processor with a combination of software and hardware are shown and described below in connection with FIGS. 5 and 6. Thus, for example, any of the example image data generator 302 (including the example scaler 304 and the example ditherer 306), the example image data converter 308, the example subpixel aging compensator 310, an example subpixel sampler 312, the example subpixel usage accumulator 314, the example pixel usage database 316, the example correction value calculator 318, the example correction value database 320, the example communications interface 322, and/or, more generally, the example host processor 102 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example image data generator 302 (including the example scaler 304 and the example ditherer 306), the example image data converter 308, the example subpixel aging compensator 310, an example subpixel sampler 312, the example subpixel usage accumulator 314, the example pixel usage database 316, the example correction value calculator 318, the example correction value database 320, and/or the example communications interface 322 is/are hereby expressly defined to include a non-transitory computer readable storage device or storage disk such as a memory, a digital versatile disk (DVD), a compact disk (CD), a Blu-ray disk, etc. including the software and/or firmware. Further still, the example host processor 102 of FIG. 1 may include one or more elements, processes and/or devices in addition to, or instead of, those illustrated in FIG. 3, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 4:
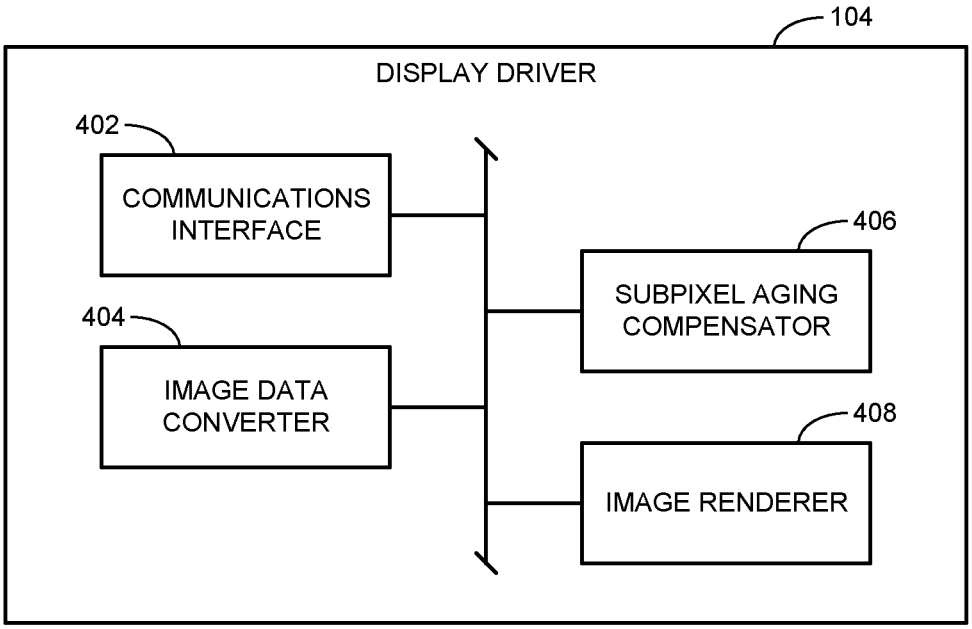
FIG. 4 is a block diagram illustrating an example implementation of the display driver of the example emissive display device of FIG. 1.

FIG. 4 is a block diagram illustrating an example implementation of the display driver 104 of the example emissive display device 100 of FIG. 1. As shown in the illustrated example, the display driver 104 includes an example communications interface 402, an example image data converter 404, an example subpixel aging compensator 406, and an example image renderer 408.

In the illustrated example, the display driver 104 is provided with the example communications interface 402 to receive image data from the host processor 102 (e.g., via the communications interface 322 of FIG. 3). In some examples, the communications interfaces 322, 402 are implemented in a high-speed serial mode such as, for example the high-speed mode in the Mobile Industry Processor Interface (MIPI) display interface protocol to reduce latency. In some examples, the image data may be in the RGB format (e.g., RGB data). In some examples, the RGB data encapsulates corrected SPR data as described above. In some examples, the RGB data is received without receiving any SPR data.

In examples where the communications interface 402 receives RGB formatted data, the image data converter 404 may convert the RGB data to SPR data for further processing. In some such examples, the subpixel aging compensator 406 may apply pixel correction values to the SPR data to correct the SPR data to compensate for pixel aging. In some examples, the pixel correction values used by the subpixel aging compensator 406 are obtained from the host processor 102 via the communications interface 404.

In the illustrated example, the display driver 104 is provided with the example image renderer 408 to control the rendering of visual content via the display screen 106 based on the corrected SPR data as generated in accordance with examples disclosed herein.

While an example manner of implementing the display driver 104 of FIG. 1 is illustrated in FIG. 4, one or more of the elements, processes and/or devices illustrated in FIG. 4 may be combined, divided, re-arranged, omitted, eliminated and/or implemented in any other way. Further, the example communications interface 402, the example image data converter 404, the example subpixel aging compensator 406, the example image renderer 408, and/or, more generally, the example display driver 104 of FIG. 4 may be implemented by hardware, software, firmware and/or any combination of hardware, software and/or firmware. Thus, for example, any of the example communications interface 402, the example image data converter 404, the example subpixel aging compensator 406, the example image renderer 408, and/or, more generally, the example display driver 104 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example communications interface 402, the example image data converter 404, the example subpixel aging compensator 406, and/or the example image renderer 408 is/are hereby expressly defined to include a non-transitory computer readable storage device or storage disk such as a memory, a digital versatile disk (DVD), a compact disk (CD), a Blu-ray disk, etc. including the software and/or firmware. Further still, the example display driver 104 of FIG. 1 may include one or more elements, processes and/or devices in addition to, or instead of, those illustrated in FIG. 4, and/or may include more than one of any or all of the illustrated elements, processes and devices.

Figure 5:
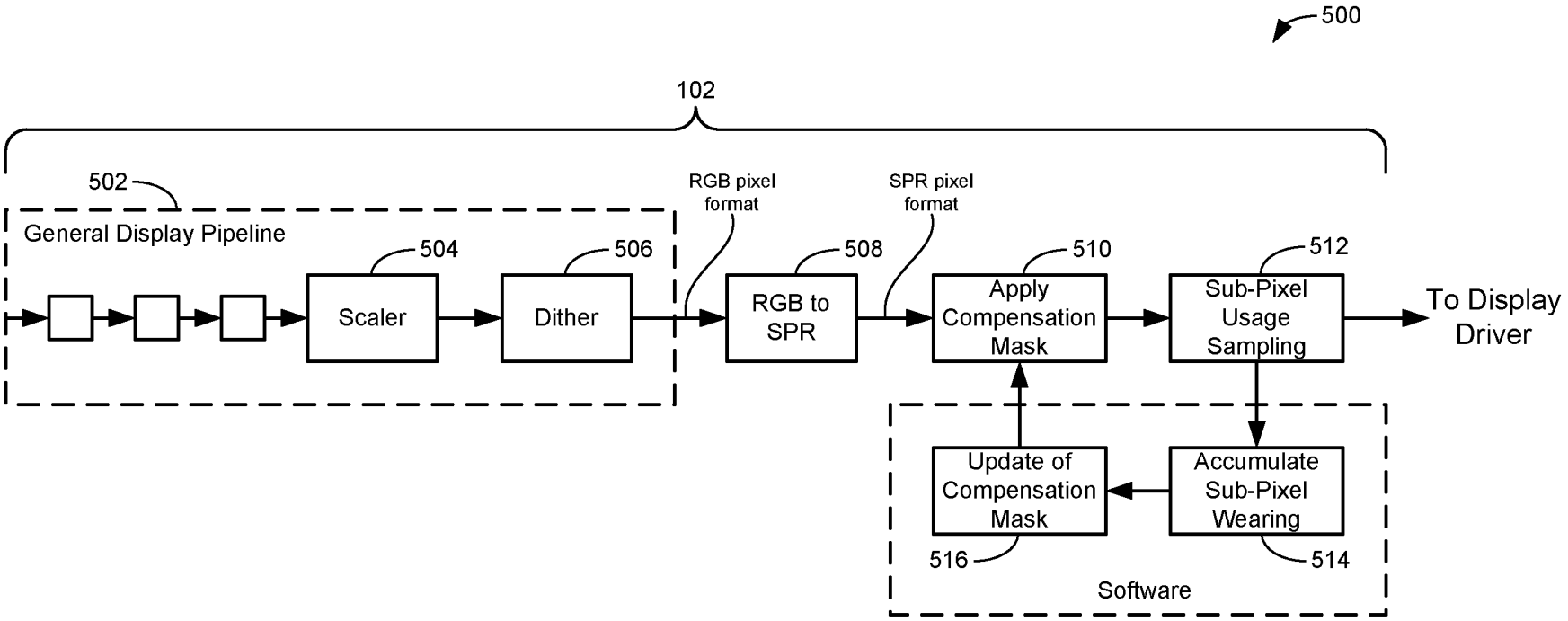
FIG. 5 is a process flow diagram representative of an example implementation of the example emissive display device of FIG. 1.

FIG. 5 illustrates an example process in the context of an example implementation of the example emissive display device of FIG. 1. More particularly, in the illustrated example of FIG. 5, all of processing blocks are implemented by the host processor 102. As shown in FIG. 5, a general display pipeline 502 includes a scaler processing block 504 and a dither processing block 506 to process image data to be rendered on the display screen. In this example, the general display pipeline 502 is implemented by the image data generator 302 of FIG. 3. The scaler processing block 504 of FIG. 5 may be implemented by the scaler 304 of FIG. 3. The dither processing block 506 of FIG. 5 may be implemented by the ditherer 306 of FIG. 3.

As shown in FIG. 5, the general display pipeline 502 provides image data in RGB format to a conversion processing block 508. The conversion processing block 508 converts the image data in the RGB format (e.g., RGB data) to an SPR format (e.g., SPR data). The conversion processing block 508 of FIG. 5 may be implemented by the image data converter 308 of FIG. 3. In the illustrated example, this resulting SPR data is provided to a compensation processing block 510 that applies pixel correction values (e.g., a compensation mask) to the SPR data to generate corrected SPR data. The compensation processing block 510 of FIG. 5 may be implemented by the subpixel aging compensator 310 of FIG. 3. The corrected SPR data produced at the compensation processing block 510 is provided to a sampling processing block 512 to sample pixel values (and/or subpixel values) from the SPR data indicative of the usage of those pixels (and/or subpixels). The sampling processing block 512 of FIG. 5 may be implemented by the subpixel sampler 312 of FIG. 3. The sampled data is accumulated over time at an accumulation processing block 514 to track the total usage or wear of each pixel being sampled over time. The accumulation processing block 514 of FIG. 5 may be implemented by the subpixel usage accumulator 314 of FIG. 3. A correction value processing block 516 involves the calculation of the pixel correction values that may be used at the compensation processing block 510 to correct the SPR data. The correction value processing block 516 of FIG. 5 may be implemented by the correction value calculator 318 of FIG. 3.

As shown in the illustrated example, the process flow follows a loop that includes the compensation processing block 510, the sampling processing block 512, the accumulation processing block 514, and the correction value processing block 516 to enable the SPR data to be corrected to properly compensate for subpixel aging over time. The corrected SPR data produced from this iterative process may be transmitted to the display driver 104. In some examples, the correct SPR data is transmitted using an SPR format protocol. This approach takes advantage of the reduced pixel count for SPR data relative to RGB data, thereby reducing the bandwidth requirements when transmitting the SPR data to the display driver. Furthermore, the reduced amount of data increases the efficiency at which the display driver 104 is able to render the data via the display screen 106. In other examples, the corrected SPR data may be encapsulated in image data transmitted using a RGB format protocol. While this approach may not achieve a reduction in bandwidth requirements, this approach enables the reuse of existing designs of display drivers (e.g., T-con processors) available today, thereby reducing costs in reengineering entirely new systems.

In the illustrated example, the accumulation processing block 514, the correction value processing block 516 are implemented via software, whereas the conversion processing block 508, the compensation processing block 510, and the sampling processing block 512 are implemented via hardware. In some examples, each of the conversion processing block 508, the compensation processing block 510, and the sampling processing block 512 are implemented via dedicated circuits integrated on a single host processor chip. In some such examples, the processor chip also includes a processor to execute instructions associated with the implementation of the accumulation processing block 514, the correction value processing block 516. The conversion processing block 508, the compensation processing block 510, and the sampling processing block 512 are implemented via hardware in this example to reduce power consumption and increase processing efficiency. Power and efficiency are particularly important considerations for the conversion processing block 508, and the compensation processing block 510 because these processing blocks operate at the frame rate of the visual content to be rendered. That is, these processes operate on every frame of image data provided by the general display pipeline 502. However, as described above, in some examples, the sampling may occur less often than every frame.

Figure 6:
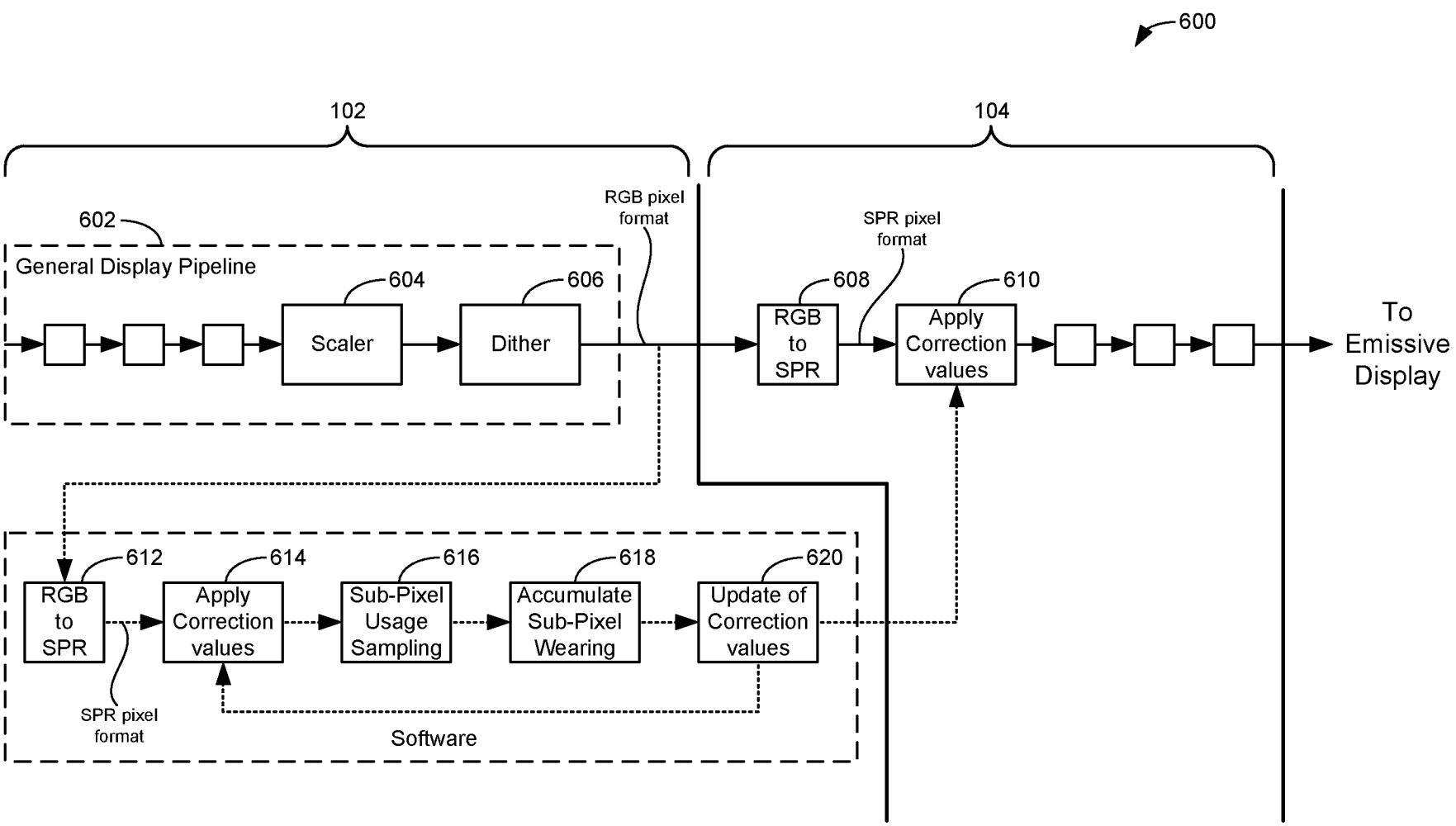
FIG. 6 is a process flow diagram representative of another example implementation of the example emissive display device of FIG. 1.

In the illustrated example, the conversion processing block 508, the compensation processing block 510, and the sampling processing block 512 execute after the general display pipeline 502. This arrangement and process flow ensures the subpixel aging compensation process (including the pixel sampling, accumulated pixel usage data, and pixel correction values) are direct matches of the SPR pixel format used to render content via the display screen 106. If any of these processes were performed before converting the RGB data to SPR data, the results of the processes would not be relevant to how the pixels of the display screen 106 are actually used based on what is actually rendered via the screen. Furthermore, converting the RGB data to SPR data before executing the aging compensation process improves the efficiency of the host processor 102 because SPR data has a reduced subpixel count relative to RGB data. Thus, there is less data to be processed by following the process flow represented in the illustrated example, thereby resulting in improved efficiency. Furthermore, with fewer pixels to be analyzed, there are fewer pixels that need to be sampled, thereby reducing the memory requirements to store the accumulated sampling data FIG. 6 is a process flow diagram 600 shown in the context of another example implementation of the example emissive display device 100 of FIG. 1. In the of FIG. 6, some of the processing blocks are implemented by the host processor 102, while other processing blocks are implemented by the display driver 104. As shown in FIG. 6, the display pipeline 602 may include a scaler processing block 604 and a dither processing block 606 to process image data to be rendered on the display screen. In some examples the general display pipeline 602 functions in the same manner as the general display pipeline 502 described above in connection with FIG. 5.

As shown in FIG. 6, the general display pipeline 602 provides image data in RGB format directly to the display driver 104. Thus, unlike the example of FIG. 5, the image data transmitted to the display driver 104 in the example of FIG. 6 has not been converted to SPR data and has not been corrected to compensate for pixel degradation. Accordingly, when the uncorrected RGB data is received at the display driver 104, the data is passed to a conversion processing block 608. The conversion processing block 608 of FIG. 6 is substantially the same as the conversion processing block 508 of FIG. 5 and functions to convert the RGB data to SPR data. In the illustrated example, the resulting SPR data is provided to a compensation processing block 610 that applies pixel correction values to the SPR data to generate corrected SPR data. The compensation processing block 610 of FIG. 6 is substantially the same as the compensation processing block 510 of FIG. 5. Once the SPR data has been corrected, subsequent processing may follow before the data is used to render content via the display screen 106.

In the illustrated example, the pixel correction values used at the compensation processing block 610 are transmitted from the host processor 102. Thus, the host processor 102 separately transmits the RGB data and the pixel correction values. The pixel correction values are generated by processing the RGB data generated by the general display pipeline 602 through a series of processing blocks including a conversion processing block 612, a compensation processing block 614, a sampling processing block 616, an accumulation processing block 618, and a correction value processing block 620. The conversion processing block 612, the compensation processing block 614, the sampling processing block 616, the accumulation processing block 618, and the correction value processing block 620 of FIG. 6 function substantially the same as the corresponding processing blocks 508, 510, 512, 514, 516 of FIG. 6. Thus, as shown in FIG. 6, the compensation processing block 614, the sampling processing block 616, an accumulating processing block 618, and the correction processing block 620 create a loop that enables the tracking of subpixel usage over time and the corresponding updating of the pixel correction values to provide accurate aging compensation.

As shown in FIG. 6, the aging compensation is bifurcated into two process paths. The first process path includes the compensation or correction of the SPR data by applying pixel correction values. In the illustrated example, this first process path is accomplished within the display driver 104. In some examples, the conversion processing block 608 and compensation processing block 610 associated with the first process path are implemented via dedicated hardware to increase efficiency because these operations are performed at the frame rate of the visual content to be rendered via the display screen 106.

The second process path in FIG. 6 includes the pixel sampling, the accumulation of pixel usage data, and the resulting generation of the pixel correction values. In the illustrated example, the second process path is implemented via software because efficiency is not as much of a concern. In particular, whereas the first process path (relating to correcting SPR data to compensate for aging) is performed for every frame, the speed of the second process path (to produce the pixel correction values) is governed by the frequency with which the image data is sampled. Thus, while the second process path includes the conversion and compensation processing blocks 612, 614 that are similar to the conversion and compensation processing block 608, 610 of the first process path, the conversion and compensation processing block 612, 614 of the second process path do not need to run nearly as frequently as those in the first process path.

A software implementation of the second process path, as shown in FIG. 6, is much more flexible than a dedicated hardware implementation. In some examples, the software associated with the second process path is customizable or reconfigurable. That is, the sampling rate of the subpixel data (and, thus, the rate at which the data conversion occurs) may be adjusted relatively easily. Likewise, the particular method used to calculate the pixel correction values may be updated or otherwise changed with relatively little lead-time or upfront hardware design costs.

Figure 7:
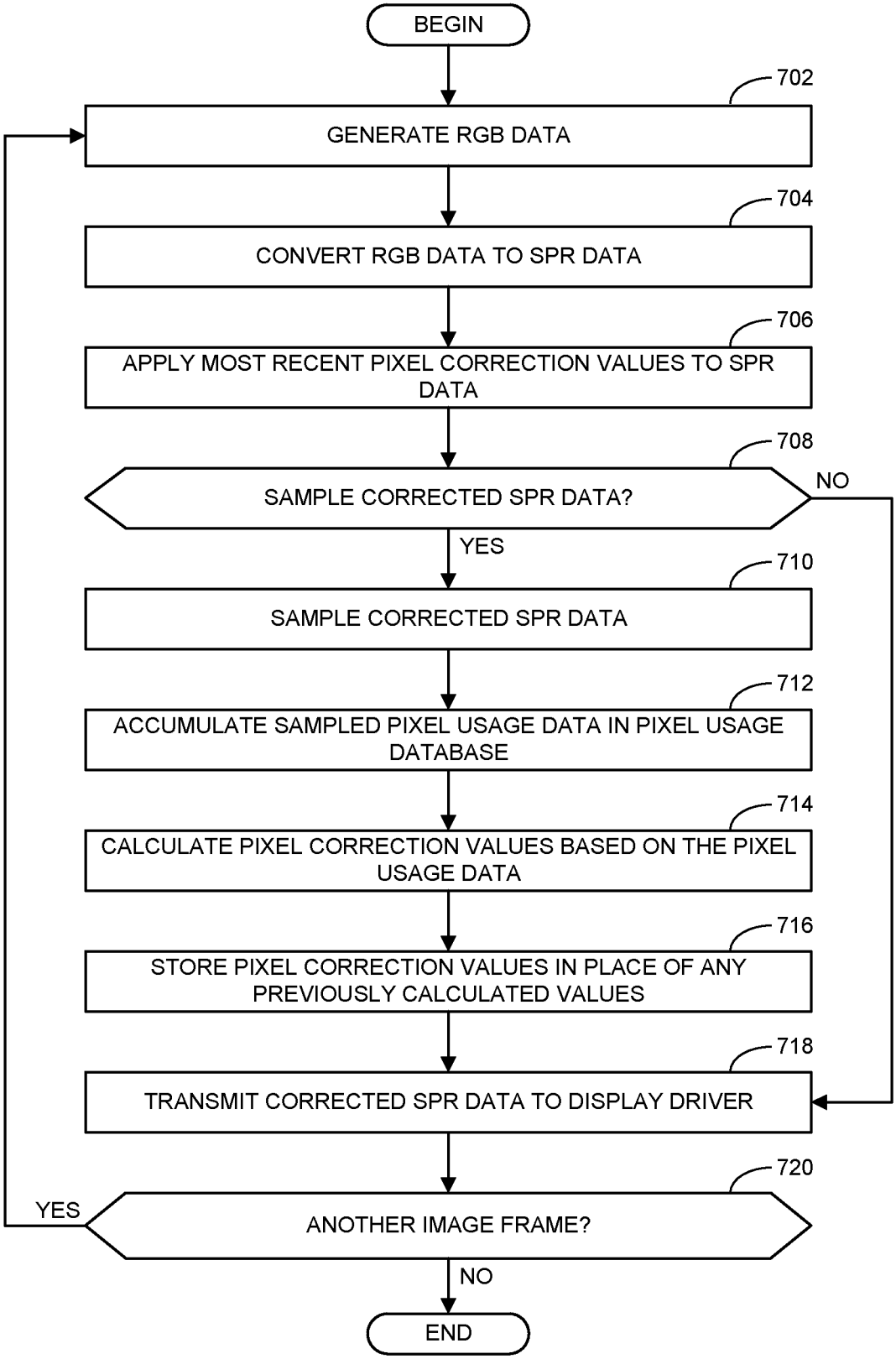
FIG. 7 is a flowchart representative of example machine readable instructions which may be executed to implement the example host processor of FIGS. 1 and/or 3 according to the example implementation of FIG. 5.
Figure 8:
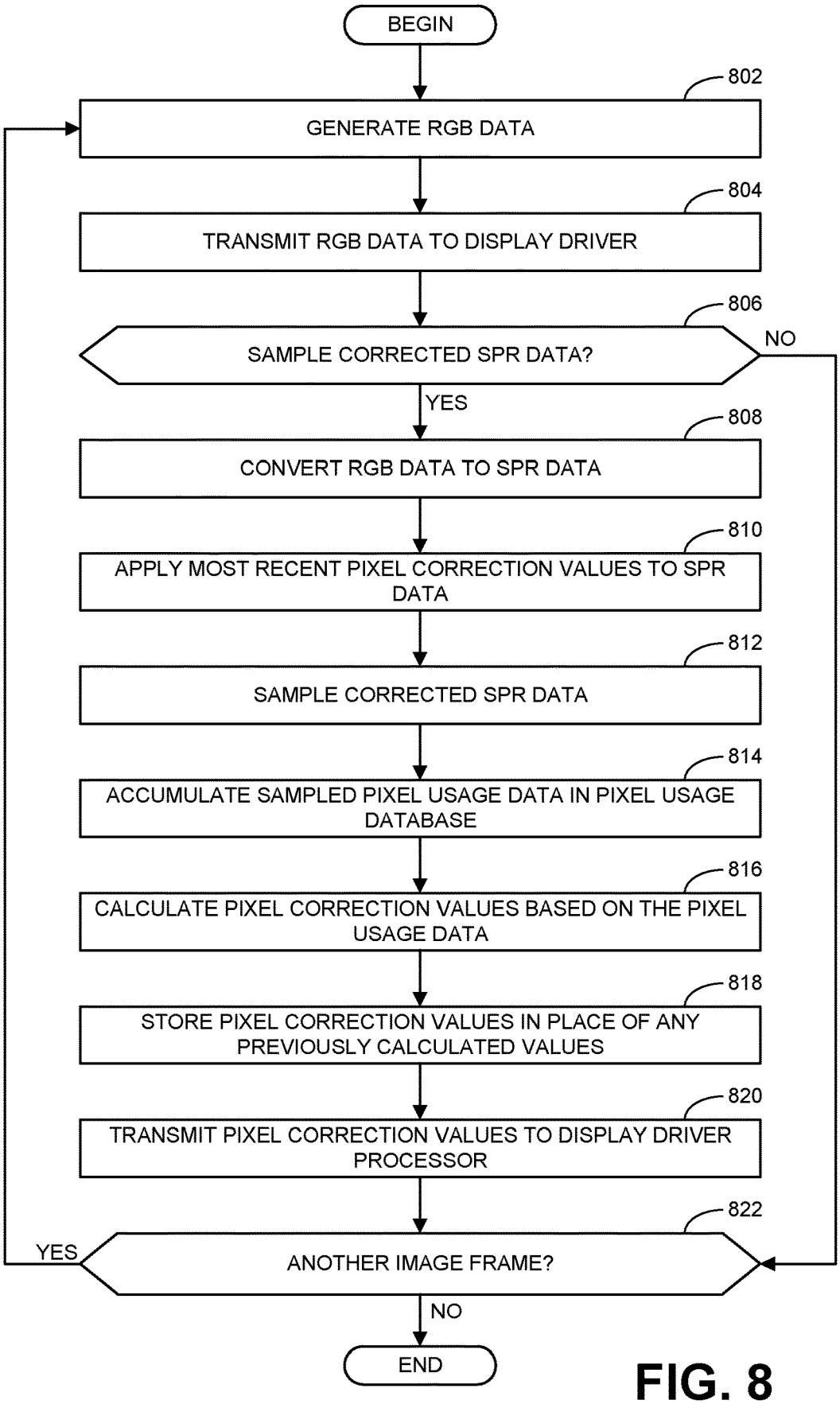
FIG. 8 is a flowchart representative of example machine readable instructions which may be executed to implement the example host processor of FIGS. 1 and/or 3 according to the example implementation of FIG. 6.
Figure 9:
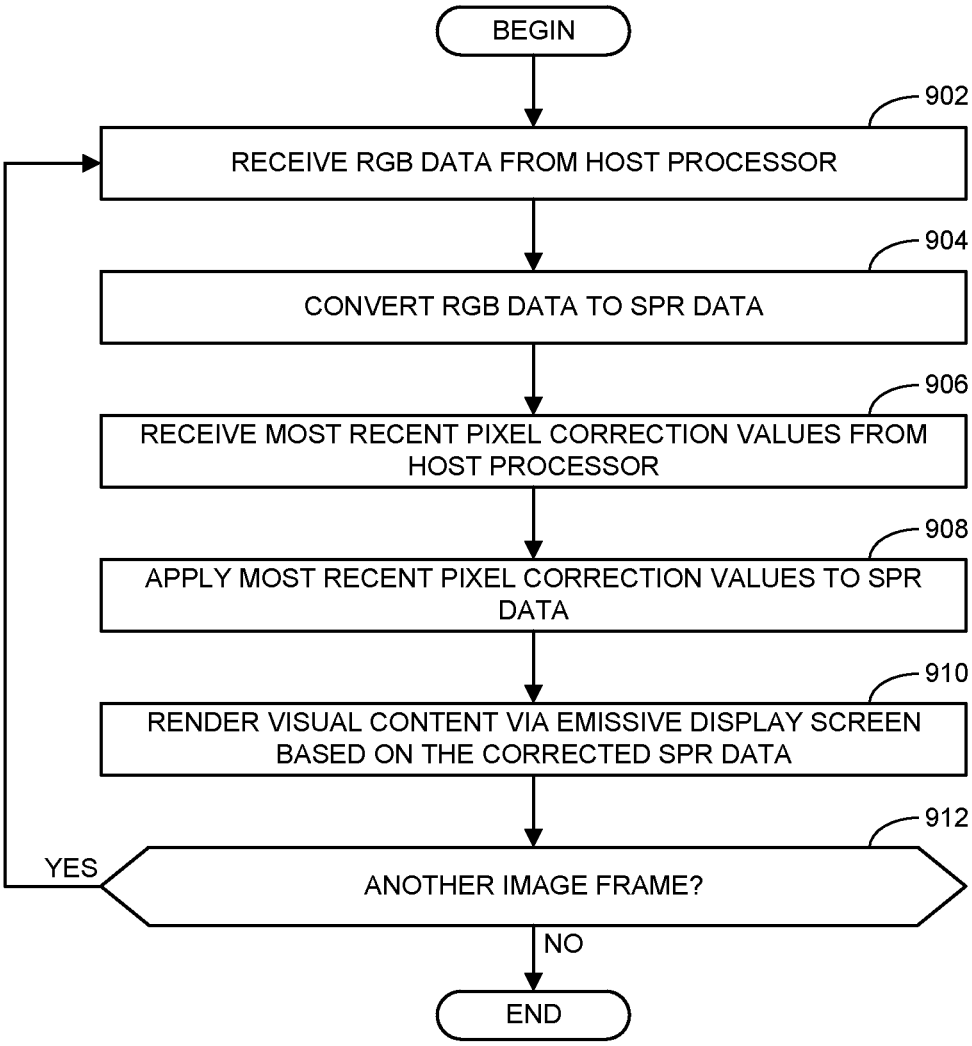
FIG. 9 is a flowchart representative of example machine readable instructions which may be executed to implement the example display driver of FIGS. 1 and/or 4 according to the example implementation of FIG. 6.

Flowcharts representative of example hardware logic or machine readable instructions for implementing the host processor 102 of FIGS. 1 and/or 3 are shown in FIGS. 7 and 8. Further, a flowchart representative of example hardware logic or machine readable instructions for implementing the display driver 104 of FIGS. 1 and/or 4 is shown in FIG. 9. The machine readable instructions may be a program or portion of a program for execution by a processor such as the processors 1012 shown in the example processor platform 1000 discussed below in connection with FIG. 10 and/or in the processor 1112 of FIG. 11. The program may be embodied in software stored on a non-transitory computer readable storage medium such as a CD-ROM, a floppy disk, a hard drive, a DVD, a Blu-ray disk, or a memory associated with the processors 1012, 1112, but the entire program and/or parts thereof could alternatively be executed by a device other than the processors 1012, 1112 and/or embodied in firmware or dedicated hardware. Further, although the example programs are described with reference to the flowcharts illustrated in FIGS. 7-9, many other methods of implementing the example host processor 102 and the display driver 104 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example processes of FIGS. 7-9 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, and (6) B with C.

Turning in detail to the flowcharts, FIG. 7 is a flowchart representative of machine readable instructions which may be executed to implement the example host processor 12 of FIGS. 1 and/or 3 according to the example implementation of FIG. 5. The example process of FIG. 7 begins at block 702 where the example image data generator 302 generates RGB data. At block 704, the example image data converter 308 converts the RGB data to SPR data. As mentioned above, this conversion may result in as much as a 30-50% reduction in the total subpixel count associated with the data, thereby enabling more efficient processing of the subsequent operations of the example process. At block 706, the example subpixel aging compensator 310 applies the most recent pixel correction values to the SPR data. As described below, the pixel correction values are generated (and updated) as the process loops through its different operations. When an emissive display device 100 is brand new such that none of the pixels of the display screen 106 have any usage history, there may be no need for compensation such that block 706 may be skipped during the first iterations of the example process.

At block 708, the example subpixel sampler 312 determines whether to sample the corrected SPR data. As mentioned above, while the compensation correction (block 706) occurs for every image frame, the sampling may occur at a much slower frequency. If the example subpixel sampler 312 determines to sample the corrected SPR data, control advances to block 710 where the example subpixel sampler 312 samples the corrected SPR data. At block 712, the example subpixel usage accumulator 314 accumulates the sampled pixel usage data in the pixel usage database 316. At block 714, the example correction value calculator 318 calculates pixel correction values based on the pixel usage data. At block 716, the example correction value database 320 stores the pixel correction values in place of any previously calculated values. That is, each time block 714 is implemented, the current (e.g., previously calculated) pixel correction values are updated with the latest calculated values. In this manner, the pixel correction values are continually updated to reflect any further aging of the pixels. At block 718, the example communications interface 322 transmits the corrected SPR data (generated at block 706) to the display driver 104.

Returning to block 708, if the example subpixel sampler 312 determines not to sample the corrected SPR data, control advances directly to block 718 to transmit the corrected SPR data. At block 720, the example process determines whether there is another image frame. If so, control returns to block 702. Otherwise, the example process of FIG. 7 ends.

FIG. 8 is a flowchart representative of machine readable instructions which may be executed to implement the example host processor 102 of FIGS. 1 and/or 3 according to the example implementation of FIG. 6. The example process of FIG. 8 begins at block 802 where the example image data generator 302 generates RGB data. At block 804, the example communications interface 322 transmits the RGB data to the display driver 104. In this example, the RGB data has not been corrected for pixel aging (nor converted to SPR format). Rather, in this example, the display driver 104 will convert the RGB data to SPR data and apply pixel correction values to compensate for aging as described further below in connection with FIG. 9.

At block 806, the example subpixel sampler 312 determines whether to sample the corrected SPR data. If the example subpixel sampler 312 determines to sample the corrected SPR data, control advances to block 808 where the example image data converter 308 converts the RGB data to SPR data. At block 810, the example subpixel aging compensator 310 applies the most recent pixel correction values to the SPR data. Unlike blocks 704 and 706 in the example process of FIG. 7, the corresponding blocks 808 and 810 in FIG. 8 occur after the subpixel sampler 312 determines to sample corrected SPR data. Thus, blocks 808 and 810 occur only as frequently as needed to implement the sampling. This may be significantly less frequently than at every frame, thereby increasing the efficiency of the host processor 102.

At block 812, the example subpixel sampler 312 samples the corrected SPR data. At block 814, the example subpixel usage accumulator 314 accumulates the sampled pixel usage data in the pixel usage database 316. At block 816, the example correction value calculator 318 calculates pixel correction values based on the pixel usage data. At block 818, the example correction value database 320 stores the pixel correction values in place of any previously calculated values. At block 820, the example communications interface 322 transmits the pixel correction values (calculated at block 816) to the display driver 104. The transmitted pixel correction values are used by the display driver 104 in conjunction with the uncorrected RGB data (transmitted at block 804) to generate corrected SPR data as discussed below in connection with FIG. 9.

At block 822, the example process determines whether there is another image frame. If so, control returns to block 802. Returning to block 806, if the example subpixel sampler 312 determines not to sample the corrected SPR data, control advances directly to block 822 to determine whether there is another image frame. Thus, unlike the example process of FIG. 7, in the example process of FIG. 8, if no sampling occurs (block 806), there is no transmission to the display driver (block 820). This is because the most recently calculated pixel correction values would have already been transmitted to the display driver 104 during a previous iteration of the example process. In some examples, the communications interface 322 may nevertheless transmit the pixel correction values regardless of whether they have changed relative to a previous transmission. If the example process determines there are no more image frames (block 822), the example process of FIG. 8 ends.

FIG. 9 is a flowchart representative of machine readable instructions which may be executed to implement the example display driver 104 of FIGS. 1 and/or 4 according to the example implementation of FIG. 6. The example process of FIG. 9, begins at block 902 where the example communications interface 402 receives RGB data from the host processor 102. This corresponds to the RGB data transmitted at block 804 of FIG. 8. Returning to FIG. 9, at block 904, the example image data converter 404 converts the RGB data to SPR data. At block 906, the example subpixel aging compensator 406 applies the most recent pixel correction values to the SPR data. In this example, the most recent pixel correction values correspond to the last pixel correction values transmitted at block 820 of FIG. 8. At block 910, the example image renderer 408 renders visual content via the emissive display screen 106 based on the corrected SPR data. At block 912, the example process determines whether there is another image frame. If so, control returns to block 902. Otherwise, the example process of FIG. 9 ends.

Figure 10:
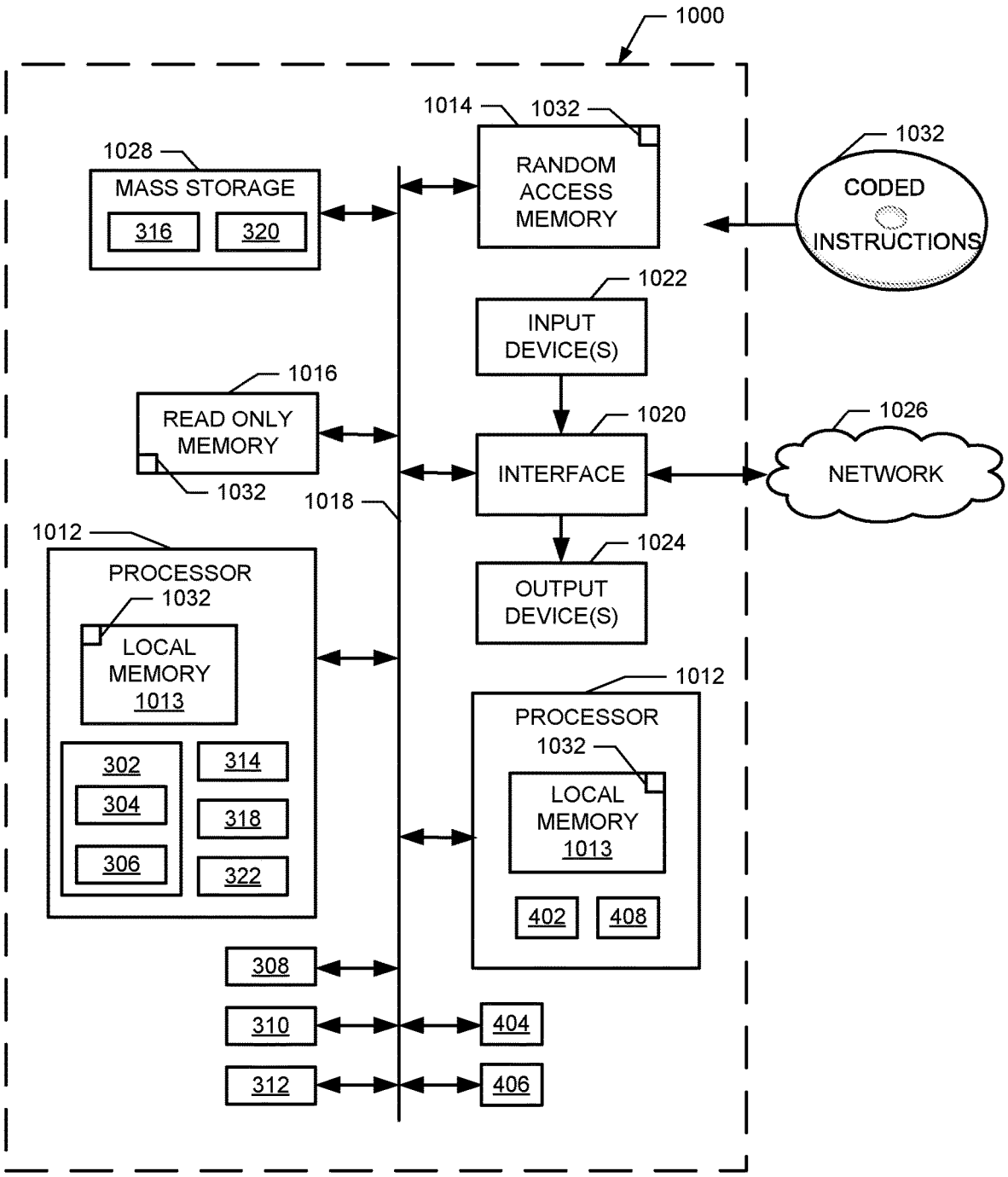
FIG. 10 is a block diagram of an example processing platform structured to execute the instructions of FIG. 7-9 to implement example emissive display device of FIG. 1.

FIG. 10 is a block diagram of an example processor platform 1000 structured to execute the instructions of FIGS. 7-9 to implement the host processor 102 and/or the display driver 104 of the emissive display device 100 of FIG. 1. The processor platform 1000 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset or other wearable device, or any other type of computing device.

The processor platform 1000 of the illustrated example includes two processors 1012. The processors 1012 of the illustrated example are hardware. For example, the processors 1012 can be implemented by one or more integrated circuits, logic circuits, microprocessors, GPUs, DSPs, or controllers from any desired family or manufacturer. The hardware processors may be a semiconductor based (e.g., silicon based) device. In this example, one of the processors 1012 is associated with the host processor 102 of FIG. 1 to implement the example image data generator 302 (including the example scaler 304 and the example ditherer 306), the example subpixel usage accumulator 314, the example correction value calculator 318, and the example communications interface 322. In the illustrated example, the example image data converter 308, the example subpixel aging compensator 310, and the example subpixel sampler 312 are implemented in dedicated hardware independent of the first processor 1012. However, in some example, the dedicated hardware may be integrated on the same processor chip as the first processor 1012. The second processor 1012 in the illustrated example is associated with the display driver 104 and implements the example communications interface 402 and the example image renderer 408. In this example, the example image data converter 404, and the example subpixel aging compensator 406 are implemented in dedicated hardware that may be integrated on the same processor chip as the second processor 1012. In some examples, the two processors 1012 may be implemented on separate chips. In other examples, they may be integrated on a single chip.

The processors 1012 of the illustrated example include a local memory 1013 (e.g., a cache). The processors 1012 of the illustrated example are in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), a Bluetooth® interface, a near field communication (NFC)

interface, and/or a PCI express interface. In some examples, the interface circuit 1020 is implemented in a proprietary interface.

In the illustrated example, one or more input devices 1022 are connected to the interface circuit 1020. The input device(s) 1022 permit(s) a user to enter data and/or commands into the processors 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a touchscreen, etc.), a tactile output device, a printer and/or speaker. The interface circuit 1020 of the illustrated example, thus, typically includes a graphics driver card, a graphics driver chip and/or a graphics driver processor.

The interface circuit 1020 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1026. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, redundant array of independent disks (RAID) systems, and digital versatile disk (DVD) drives. In the illustrated example, the mass storage devices 1028 include the example pixel usage database 316 and the example correction value database 320.

The machine executable instructions 1032 of FIGS. 7-9 may be stored in the mass storage device 1028, in the volatile memory 1014, in the non-volatile memory 1016, and/or on a removable non-transitory computer readable storage medium such as a CD or DVD.

Figure 11:
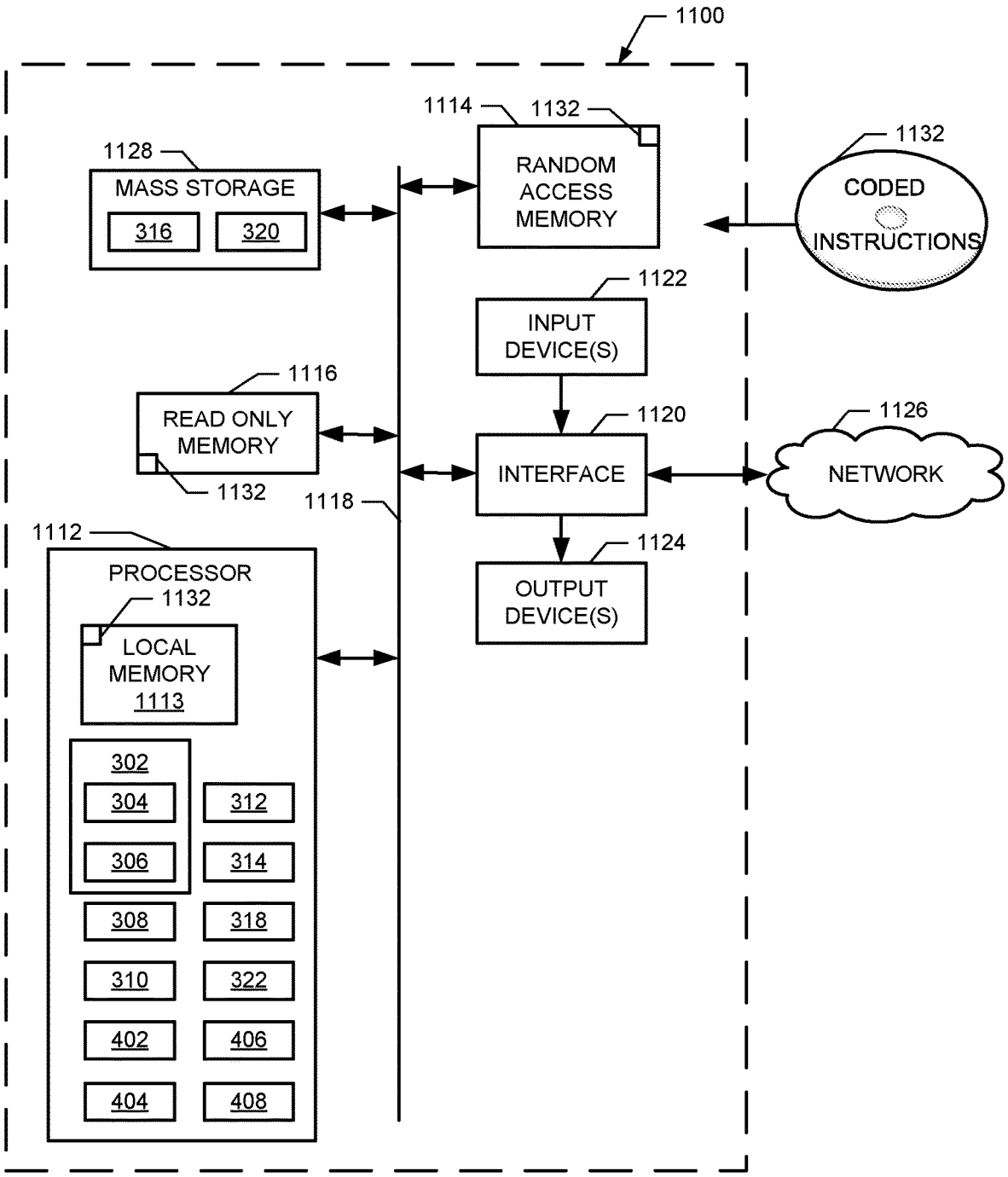
FIG. 11 is a block diagram of another example processing platform structured to execute the instructions of FIG. 7-9 to implement example emissive display device of FIG. 1.

FIG. 11 is a block diagram of another example processor platform 1100 structured to execute the instructions of FIGS. 7-9 to implement the host processor 102 and/or the display driver 104 of the emissive display device 100 of FIG. 1. The processor platform 1100 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset or other wearable device, or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors, GPUs, DSPs, or controllers from any desired family or manufacturer. The hardware processor may be a semiconductor based (e.g., silicon based) device. In this example, the processor 1112 implements example image data generator 302 (including the example scaler 304 and the example ditherer 306), the example image data converter 308, the example subpixel aging compensator 310, the example subpixel sampler 312, the example subpixel usage accumulator 314, the example correction value calculator 318, and the example communications interface 322 of the host processor 102. Further, the same processor 1112 also implements the example communications interface 402, the example image data converter 404, the example subpixel aging compensator 406, and the example image renderer 408 of the display driver 104. OF course, in some examples, one of more of the blocks of the host processor 102 and/or the display driver 104 (e.g., the example image data converters 308, 404 and/or the example subpixel aging compensators 310, 406) may be implemented in dedicated hardware separate from the processor.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), a Bluetooth® interface, a near field communication (NFC) interface, and/or a PCI express interface.

In the illustrated example, one or more input devices 1122 are connected to the interface circuit 1120. The input device(s) 1122 permit(s) a user to enter data and/or commands into the processor 1112. The input device(s) can be implemented by, for example, an audio sensor, a microphone, a camera (still or video), a keyboard, a button, a mouse, a touchscreen, a track-pad, a trackball, and/or a voice recognition system.

One or more output devices 1124 are also connected to the interface circuit 1120 of the illustrated example. The output devices 1124 can be implemented, for example, by display devices (e.g., a light emitting diode (LED), an organic light emitting diode (OLED), a touchscreen, etc.), a tactile output device, a printer and/or speaker. The interface circuit 1120 of the illustrated example, thus, typically includes a graphics driver card, a graphics driver chip and/or a graphics driver processor.

The interface circuit 1120 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1126. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, redundant array of independent disks (RAID) systems, and digital versatile disk (DVD) drives. In the illustrated example, the mass storage devices 1028 include the example pixel usage database 316 and the example correction value database 320.

The machine executable instructions 1132 of FIGS. 7-9 may be stored in the mass storage device 1128, in the volatile memory 1114, in the non-volatile memory 1116, and/or on a removable non-transitory computer readable storage medium such as a CD or DVD.

From the foregoing, it will be appreciated that example methods, apparatus and articles of manufacture have been disclosed that enable aging compensation for emissive displays with increased processor efficiency and reduced memory requirements than is possible with previously known solutions. These improvements to emissive display devices are made possible in part by taking advantage of the reduce subpixel count associated with image data in the SPR format relative to similar image data in the RGB format. More particular, examples convert RGB data into SPR data before calculating pixel correction values used to compensate the SPR data to account for pixel degradation. In addition to increasing efficiency, converting RGB data to SPR data before performing aging compensation enables improved image quality on emissive displays because the aging compensation is based on the same format of data (e.g., the SPR format) that is used to render an image on the display.

Example 1 is an apparatus that includes: a converter to convert red-green-blue (RGB) data to subpixel rendering (SPR) data, the RGB data indicative of an image to be rendered on an emissive display screen; a compensator to apply pixel correction values to the SPR data to generate corrected SPR data to compensate for pixel degradation; a usage accumulator to track at least one of pixel usage or subpixel usage based on the corrected SPR data; and a correction calculator to calculate the pixel correction values based on the pixel usage.

Example 2 includes the subject matter of Example 1, and further includes a subpixel sampler to sample the corrected SPR data, the usage accumulator to track the at least one of the pixel usage or the subpixel usage by adding at least one of usage of pixels or usage of subpixels indicated by the sampled corrected SPR data to stored pixel usage data.

Example 3 includes the subject matter of Example 2, wherein the subpixel sampler is to sample the corrected SPR data at a first frame rate, the compensator to apply the pixel correction values to the SPR data at a second frame rate faster than the first frame rate, the first frame rate being configurable.

Example 4 includes the subject matter of any one of Examples 1-3, and further includes a communications interface to transmit corrected SPR data to a display driver, the display driver to render the image via the emissive display screen.

Example 5 includes the subject matter of Example 4, wherein the communications interface is to transmit the corrected SPR data in accordance with an RGB format protocol.

Example 6 includes the subject matter of Example 4, wherein the communications interface is to transmit the corrected SPR data in accordance with an SPR format protocol.

Example 7 includes the subject matter of Example 6, wherein at least one of the converter or the compensator are implemented via at least one hardware logic circuit on a host processor chip, the host processor chip being separate from the display driver.

Example 8 includes the subject matter of any one of Examples 1-7, wherein the usage accumulator is implemented by a first processor executing instructions stored in a memory, and the compensator is implemented via a hardware circuit associated with a second processor separate from the first processor.

Example 9 includes the subject matter of any one of Examples 1-8, wherein the pixel correction values correspond to a compensation mask applied through alpha blending.

Example 10 includes the subject matter of any one of Examples 1-9, and further includes a correction value database to store the pixel correction values in a lookup table.

Example 11 includes the subject matter of any one of Examples 1-10, and further includes the emissive display screen to render the image as compensated by the pixel correction values.

Example 12 is a non-transitory computer readable medium comprising instructions that, when executed, cause at least one processor to at least: convert red-green-blue (RGB) data to subpixel rendering (SPR) data, the RGB data indicative of an image to be rendered on an emissive display screen; apply pixel correction values to the SPR data to generate corrected SPR data to compensate for pixel degradation; update pixel usage data based on the corrected SPR data; and calculate the pixel correction values based on the updated pixel usage data.

Example 13 includes the subject matter of Example 12, wherein the instructions further cause the at least one processor to: sample the corrected SPR data; and update the pixel usage data by adding additional pixel usage data indicated by the sampled corrected SPR data to stored pixel usage data.

Example 14 includes the subject matter of Example 13, wherein the instructions further cause the at least one processor to: sample the corrected SPR data at a first frame rate; and apply the pixel correction values to the SPR data at a second frame rate faster than the first frame rate, the first frame rate being configurable.

Example 15 includes the subject matter of any one of Examples 12-14, wherein the instructions further cause the at least one processor to transmit corrected SPR data to a display driver, the display driver to render the image via the emissive display screen.

Example 16 includes the subject matter of Example 15, wherein the instructions further cause the at least one processor to transmit the corrected SPR data according to an RGB protocol.

Example 17 includes the subject matter of Example 16, wherein the instructions further cause the at least one processor to transmit corrected SPR data with the RGB data.

Example 18 includes the subject matter of Example 15, wherein the instructions further cause the at least one processor to transmit the corrected SPR data according to an SPR protocol.

Example 19 includes the subject matter of any one of Examples 12-18, wherein the pixel correction values correspond to a compensation mask.

Example 20 includes the subject matter of any one of Examples 12-19, wherein the instructions further cause the at least one processor to store the pixel correction values in a lookup table.

Example 21 includes the subject matter of any one of Examples 12-20, wherein the instructions further cause the at least one processor to render the image via the emissive display screen based on the corrected SPR data.

Example 22 is a system that includes: means for converting red-green-blue (RGB) data to subpixel rendering (SPR) data, the RGB data indicative of an image to be rendered on an emissive display screen; means for applying pixel correction values to the SPR data to generate corrected SPR data to compensate for pixel degradation; means for updating pixel usage data based on the corrected SPR data; and means for calculating the pixel correction values based on the updated pixel usage data.

Example 23 includes the subject matter of Example 22, and further includes means for sampling the corrected SPR data, the means for updating the pixel usage data to combine the sampled corrected SPR data with the pixel usage data.

Example 24 includes the subject matter of Example 23, wherein the means for sampling is to sample the corrected SPR data at a first frame rate, the means for applying is to apply the pixel correction values to the SPR data at a second frame rate faster than the first frame rate, the first frame rate being configurable.

Example 25 includes the subject matter of any one of Examples 22-24, and further includes means for transmitting the corrected SPR data to a display driver, the display driver to render the image via the emissive display screen.

Example 26 includes the subject matter of Example 25, wherein the means for transmitting is to transmit the corrected SPR data according to an RGB format protocol.

Example 27 includes the subject matter of Example 26, wherein the means for transmitting is to transmit the corrected SPR data according to the RGB data protocol.

Example 28 includes the subject matter of Example 25, wherein the means for transmitting is to transmit the corrected SPR data according to an SPR format.

Example 29 is a method that includes: converting, via at least one logic circuit, red-green-blue (RGB) data to subpixel rendering (SPR) data, the RGB data indicative of an image to be rendered on an emissive display screen; applying, via the at least one logic circuit, pixel correction values to the SPR data to generate corrected SPR data to compensate for at least one of pixel degradation or subpixel degradation; updating, via the at least one logic circuit, pixel usage data based on the corrected SPR data; and calculating, via the at least one logic circuit, the pixel correction values based on the updated pixel usage data.

Example 30 includes the subject matter of Example 29, wherein the updating of the pixel usage data includes: sampling the corrected SPR data; and adding additional pixel usage data indicated by the sampled corrected SPR data to previously stored pixel usage data.

Example 31 includes the subject matter of Example 30, and further includes: sampling the corrected SPR data at a first frame rate; and applying the pixel correction values to the SPR data at a second frame rate faster than the first frame rate, the first frame rate being configurable.

Example 32 includes the subject matter of any one of Examples 29-31, and further includes transmitting the corrected SPR data to a display driver, the display driver to render the image via the emissive display screen.

Example 33 includes the subject matter of Example 32, and further includes transmitting the corrected SPR data according to a RGB format protocol.

Example 34 includes the subject matter of Example 33, wherein the corrected SPR data is transmitted according to the RGB data protocol.

Example 35 includes the subject matter of Example 32, and further includes transmitting the corrected SPR data according to a SPR format protocol.

Example 36 includes the subject matter of any one of Examples 29-35, wherein at least one of the converting of the RGB data to the SPR data or the applying of the pixel correction values are implemented via at least one hardware logic circuit integrated on a host processor chip, the host processor chip being separate from the display driver.

Example 37 includes the subject matter of any one of Examples 29-36, wherein the converting the RGB data to the SPR data and the applying the pixel correction values are implemented via at least one hardware logic circuit integrated on a host processor chip.

Example 38 includes the subject matter of any one of Examples 29-37, wherein the updating of the pixel usage data is implemented by a first processor executing instructions stored in a memory, and the applying of the pixel correction values is implemented via a second processor separate from the first processor.

Example 39 includes the subject matter of any one of Examples 29-38, wherein the pixel correction values corresponds to a compensation mask applied through alpha blending.

Example 40 includes the subject matter of any one of Examples 29-39, and further includes storing the pixel correction values in a lookup table.

Example 41 includes the subject matter of any one of Examples 29-40, and further includes rendering the image via the emissive display screen based on the corrected SPR data.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a converter to convert red-green-blue (RGB) data to subpixel rendering (SPR) data, the RGB data indicative of an image to be rendered on an emissive display screen;

a compensator to apply pixel correction values to the SPR data to generate corrected SPR data to compensate for pixel degradation;

a subpixel sampler to sample the corrected SPR data to generate sampled corrected SPR data;

a usage accumulator to track pixel usage by adding at least one of usage of pixels or usage of subpixels indicated by the sampled corrected SPR data to stored pixel usage data; and a correction calculator to calculate the pixel correction values based on the pixel usage.

2. The apparatus as defined in claim 1, further including a communications interface to transmit the corrected SPR data to a display driver, the display driver to render the image via the emissive display screen.

3. The apparatus as defined in claim 2, wherein the communications interface is to transmit the corrected SPR data in accordance with an RGB format protocol.

4. The apparatus as defined in claim 2, wherein the communications interface is to transmit the corrected SPR data in accordance with an SPR format protocol.

5. The apparatus as defined in claim 4, wherein at least one of the converter or the compensator are implemented via at least one hardware logic circuit on a host processor chip, the host processor chip being separate from the display driver.

6. The apparatus as defined in claim 1, wherein the usage accumulator is implemented by a first processor to execute instructions stored in a memory, and the compensator is implemented via a hardware circuit associated with a second processor separate from the first processor.

7. The apparatus as defined in claim 1, wherein the pixel correction values correspond to a compensation mask applied through alpha blending.

8. The apparatus as defined in claim 1, further including a correction value database to store the pixel correction values in a lookup table.

9. The apparatus as defined in claim 1, further including the emissive display screen to render the image as compensated by the pixel correction values.

10. The apparatus as defined in claim 1, wherein the RGB data is representative of a first plurality of logic pixels and the SPR data is representative of a second plurality of logic pixels, each of the first plurality of logic pixels associated with three full subpixels, at least some of the second plurality of logic pixels associated with less than three full subpixels.

11. The apparatus as defined in claim 1, wherein the RGB data is associated with a first total count of subpixels and the SPR data is associated with a second total count of subpixels, the second total count less than the first total count.

12. The apparatus as defined in claim 1, wherein the RGB data is associated with a first amount of data and the SPR data is associated with a second amount of data, the second amount of data less than the first amount of data.

13. A non-transitory computer readable medium comprising instructions that, when executed, cause at least one processor to at least:

convert red-green-blue (RGB) data to subpixel rendering (SPR) data, the RGB data indicative of an image to be rendered on an emissive display screen;

apply pixel correction values to the SPR data to generate corrected SPR data to compensate for pixel degradation;

sample the corrected SPR data to generate sampled corrected SPR data;

update pixel usage data by adding additional pixel usage data indicated by the sampled corrected SPR data to stored pixel usage data; and calculate the pixel correction values based on the updated pixel usage data.

14. The non-transitory computer readable medium as defined in claim 13, wherein the instructions further cause the at least one processor to transmit the corrected SPR data to a display driver, the display driver to render the image via the emissive display screen.

15. The non-transitory computer readable medium as defined in claim 14, wherein the instructions further cause the at least one processor to transmit the corrected SPR data according to an RGB protocol.

16. The non-transitory computer readable medium as defined in claim 15, wherein the instructions further cause the at least one processor to transmit the corrected SPR data with the RGB data.

17. The non-transitory computer readable medium as defined in claim 14, wherein the instructions further cause the at least one processor to transmit the corrected SPR data according to an SPR protocol.

18. A system comprising:

means for converting red-green-blue (RGB) data to subpixel rendering (SPR) data, the RGB data indicative of an image to be rendered on an emissive display screen;

means for applying pixel correction values to the SPR data to generate corrected SPR data to compensate for pixel degradation;

means for sampling the corrected SPR data to generate sampled corrected SPR data;

means for updating pixel usage data by combining the sampled corrected SPR data with the pixel usage data; and means for calculating the pixel correction values based on the updated pixel usage data.

19. The system as defined in claim 18, wherein the means for sampling is to sample the corrected SPR data at a first frame rate, the means for applying is to apply the pixel correction values to the SPR data at a second frame rate faster than the first frame rate, the first frame rate being configurable.

20. A method comprising:

converting, via at least one logic circuit, red-green-blue (RGB) data to subpixel rendering (SPR) data, the RGB data indicative of an image to be rendered on an emissive display screen;

applying, via the at least one logic circuit, pixel correction values to the SPR data to generate corrected SPR data to compensate for at least one of pixel degradation or subpixel degradation;

sampling the corrected SPR data to generate sampled corrected SPR data;

updating, via the at least one logic circuit, pixel usage data by adding additional pixel usage data indicated by the sampled corrected SPR data to previously stored pixel usage data; and calculating, via the at least one logic circuit, the pixel correction values based on the updated pixel usage data.

21. The method as defined in claim 20, further including transmitting the corrected SPR data to a display driver, the display driver to render the image via the emissive display screen.

22. The method as defined in claim 20, wherein at least one of the converting of the RGB data to the SPR data or the applying of the pixel correction values are implemented via at least one hardware logic circuit integrated on a host processor chip, the host processor chip being separate from a display driver.

23. The method as defined in any claim 20, wherein the converting of the RGB data to the SPR data and the applying of the pixel correction values are implemented via at least one hardware logic circuit integrated on a host processor chip.

24. The method as defined in claim 20, wherein the updating of the pixel usage data is implemented by a first processor executing instructions stored in a memory, and the applying of the pixel correction values is implemented via a second processor separate from the first processor.

* * * * *